US005133790A

United States Patent [19]

Bianchi et al.

[11] Patent Number: 5,133,790

[45] Date of Patent: Jul. 28, 1992

[54] CRYOGENIC RECTIFICATION METHOD FOR PRODUCING REFINED ARGON

[75] Inventors: John R. Bianchi, East Amherst; Dante P. Bonaquist; Richard A. Victor, both of Grand Island, all of N.Y.

[73] Assignee: Union Carbide Industrial Gases Technology Corporation, Danbury, Conn.

[21] Appl. No.: 720,252

[22] Filed: Jun. 24, 1991

[51] Int. Cl.[5] ..... F25J 3/04; C01B 23/00

[52] U.S. Cl. ..... 62/22; 62/24; 423/262

[58] Field of Search ..... 62/22, 24; 55/66; 423/262

[56] References Cited

U.S. PATENT DOCUMENTS

| | | | |
|---|---|---|---|
| 2,547,177 | 4/1951 | Simpson | 62/175.5 |
| 2,700,282 | 1/1955 | Roberts | 62/175.5 |
| 2,762,208 | 9/1956 | Dennis | 62/122 |
| 4,433,990 | 2/1984 | Olszewski | 62/22 |
| 4,477,265 | 10/1984 | Kumar et al. | 55/26 |
| 4,817,394 | 4/1989 | Erickson | 62/22 |
| 4,818,262 | 4/1989 | Brugerolle | 62/22 |
| 4,822,395 | 4/1989 | Cheung | 62/22 |
| 4,824,453 | 4/1989 | Rottmann et al. | 62/22 |
| 4,832,719 | 5/1989 | Erickson | 62/22 |
| 4,836,836 | 6/1989 | Bennett et al. | 62/22 |
| 4,838,913 | 6/1989 | Victor et al. | 62/22 |
| 4,842,625 | 6/1989 | Allam et al. | 62/22 |
| 4,871,382 | 10/1989 | Thorogood | 62/22 X |
| 4,983,194 | 1/1991 | Hopkins et al. | 62/22 |
| 4,994,098 | 2/1991 | Agrawal et al. | 62/22 |
| 5,019,144 | 5/1991 | Victor et al. | 62/22 |
| 5,019,145 | 5/1991 | Rohde et al. | 62/22 |
| 5,076,823 | 12/1991 | Hansel et al. | 62/22 |
| 5,077,978 | 1/1992 | Agrawal et al. | 62/22 |
| 5,078,766 | 1/1992 | Guilleminot | 62/22 |
| 5,079,923 | 1/1992 | Grenier | 62/22 |
| 5,084,081 | 1/1992 | Rohde | 62/22 |

FOREIGN PATENT DOCUMENTS 3840506 6/1990 Fed. Rep. of Germany .

OTHER PUBLICATIONS

Lockhart, Multi-Column Distillation of Natural Gasoline, Petroleum Refiners, vol. 26, No. 8, pp. 104–108, (1947).

Latimer, Distillation of Air, Chemical Engineering Progress, vol. 63, No. 2, pp. 35–59, (1967).

Alekseev et al., Film Fractionation of Air in Apparatus With Regular Crimped Packing, Chemical and Petroleum Engineering 9/75, 1070–3 (1974).

Zel'venskii et al., Low Temperature Rectification of Argon to Remove Oxygen in Columns with Polymer Packing, Kis. Prom., 5 (1978) pp. 4–8.

Tedder et al., Parametric Studies in Industrial Distillation, AIChE Journal, 24, 2, pp. 303–334 (1978).

Yamazaki et al., Air Separation Plant With Argon Recovery Equipment, Hitachi Review, 28, 1, pp. 43–48 (1979).

*Primary Examiner*—Henry A. Bennet
*Assistant Examiner*—Christopher B. Kilner
*Attorney, Agent, or Firm*—Stanley Ktorides

[57] ABSTRACT

A cryogenic rectification method employing rectification over a defined height within the lower pressure column of a double column system which reduces the nitrogen concentration of an argon, nitrogen, oxygen mixture while maintaining the argon concentration at or near its maximum enabling production of nitrogen-free argon directly from the argon column system.

16 Claims, 6 Drawing Sheets

CRYOGENIC RECTIFICATION METHOD FOR PRODUCING REFINED ARGON

TECHNICAL FIELD

This invention relates generally to cryogenic rectification and more particularly to cryogenic rectification for the production of argon.

BACKGROUND ART

Crude argon having an argon concentration of about 98 percent or less is produced by the cryogenic rectification of air. Argon comprises less than 1 percent of air. Typically air is separated into oxygen and nitrogen by use of a double column system comprising a higher pressure column in heat exchange relation with a lower pressure column. At or near the point in the lower pressure column where the concentration of argon is at a maximum, a stream is withdrawn from the lower pressure column and passed into an argon column for rectification into crude argon. The argon concentration of the argon column feed stream is about 7 to 12 percent so that effective argon recovery can be attained by use of the argon column system. The remainder of the argon column feed stream comprises oxygen and nitrogen.

In the argon column the feed is separated by cryogenic rectification. The less volatile component, oxygen, concentrates at the bottom of the column and the more volatile argon concentrates at the top of the column. Nitrogen, which is even more volatile than argon, goes with the argon.

From the top of the column a crude argon stream, generally comprising about 95 to 98 percent argon is removed for further processing to produce high purity or refined argon. The remainder of the crude argon stream comprises oxygen and nitrogen.

Oxygen is removed from the crude argon stream by mixing it with hydrogen and passing the mixture through a catalytic hydrogenation unit wherein the hydrogen and oxygen react to form water. The stream is then passed through a dryer for the removal of the water. Alternatively the oxygen may be removed from the crude argon stream by kinetic adsorption thereby reducing or eliminating the need for catalytic hydrogenation and the associated hydrogen requirements.

Once the oxygen has been removed from the crude argon stream, the nitrogen is separated from the argon by cryogenic distillation. The resulting high purity or refined argon, having an oxygen concentration generally less than 2 ppm and a nitrogen concentration generally less than 2 ppm, is now suitable for commercial use.

The capital and operating cost of producing refined argon from the crude argon recoverable from the argon column system is considerable and thus it is desirable to have a system whereby refined argon may be recovered directly from the argon column system.

It is known that the separation of argon and oxygen in the argon column may be essentially complete if sufficient equilibrium stages are incorporated into the argon column. Generally at least 150 equilibrium stages in the argon column are required for this purpose. In such a situation essentially all of the oxygen in the argon column feed is separated from the argon and the crude argon removed from the top of the column contains essentially no oxygen. However, because of the relative volatilities of these components, the nitrogen goes with the argon and thus a separate nitrogen removal step is still required to process the crude argon stream into refined argon Accordingly it is an object of this invention to provide a cryogenic rectification method which enables one to recover nitrogen-free argon directly from an argon column system.

It is another object of this invention to provide a cryogenic rectification method which enables one to recover refined argon directly from an argon column system

SUMMARY OF THE INVENTION

The above and other objects which will become apparent to one skilled in the art upon a reading of this disclosure are attained by:

A method for producing nitrogen-free argon comprising:

(A) separating a feed comprising argon, nitrogen and oxygen by cryogenic distillation in a double column system comprising a higher pressure column and a lower pressure column;

(B) withdrawing a fluid stream from the lower pressure column and passing this stream as argon column feed into an argon column system;

(C) operating the lower pressure column with sufficient equilibrium stages comprising packing above the point where the argon column feed is withdrawn from the lower pressure column so that the withdrawal of the argon column feed from the lower pressure column occurs at least 5 equilibrium stages below where the argon concentration in the lower pressure column is at a maximum and the nitrogen concentration in the argon column feed is less than 50 ppm; and (D) recovering directly from the argon column system argon having a nitrogen concentration not exceeding 10 ppm.

The term, "column", as used in the present specification and claims means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column and/or on packing elements. For a further discussion of distillation columns see the Chemical Engineers' Handbook. Fifth Edition, edited by R. H. Perry and C. H. Chilton, McGraw-Hill Book Company, New York, Section 13, "Distillation" B. D. Smith et al, page 13-3, *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commerical Air Separation.

Vapor and liquid contacting separation processes depend on the difference in vapor pressures will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns.

The term "indirect heat exchange", as used in the present specification and claims, means the bringing of two fluid streams into heat exchange relation without any physical contact or intermixing of the fluids with each other.

As used herein, the term "packing" means any solid or hollow body of predetermined configuration, size, and shape used as column internals to provide surface area for the liquid to allow mass transfer at the liquid-vapor interface during countercurrent flow of the two phases.

As used herein, the term "structured packing" means packing wherein individual members have specific orientation relative to each other and to the column axis.

As used herein the term "random packing" means packing wherein individual members have no specific orientation relative to each other and to the column axis.

As used herein the term "argon column system" means a system comprising a column and a top condenser which processes a feed comprising argon and produces a product having an argon concentration which exceeds that of the feed.

As used herein the term "top condenser" means a heat transfer device used to liquefy vapor rising from the top of the argon column.

As used herein the term "equilibrium stage" means a contact process between vapor and liquid such that the exiting vapor and liquid streams are in equilibrium.

DETAILED DESCRIPTION

The invention comprises in general the modification to a conventional lower pressure column of a double column system by the addition of defined equilibrium stages above the argon column feed point in a manner which further separates argon from nitrogen in the lower pressure column thereby reducing the nitrogen concentration of the argon column feed stream while not significantly reducing the argon concentration of the stream.

Figure 1:
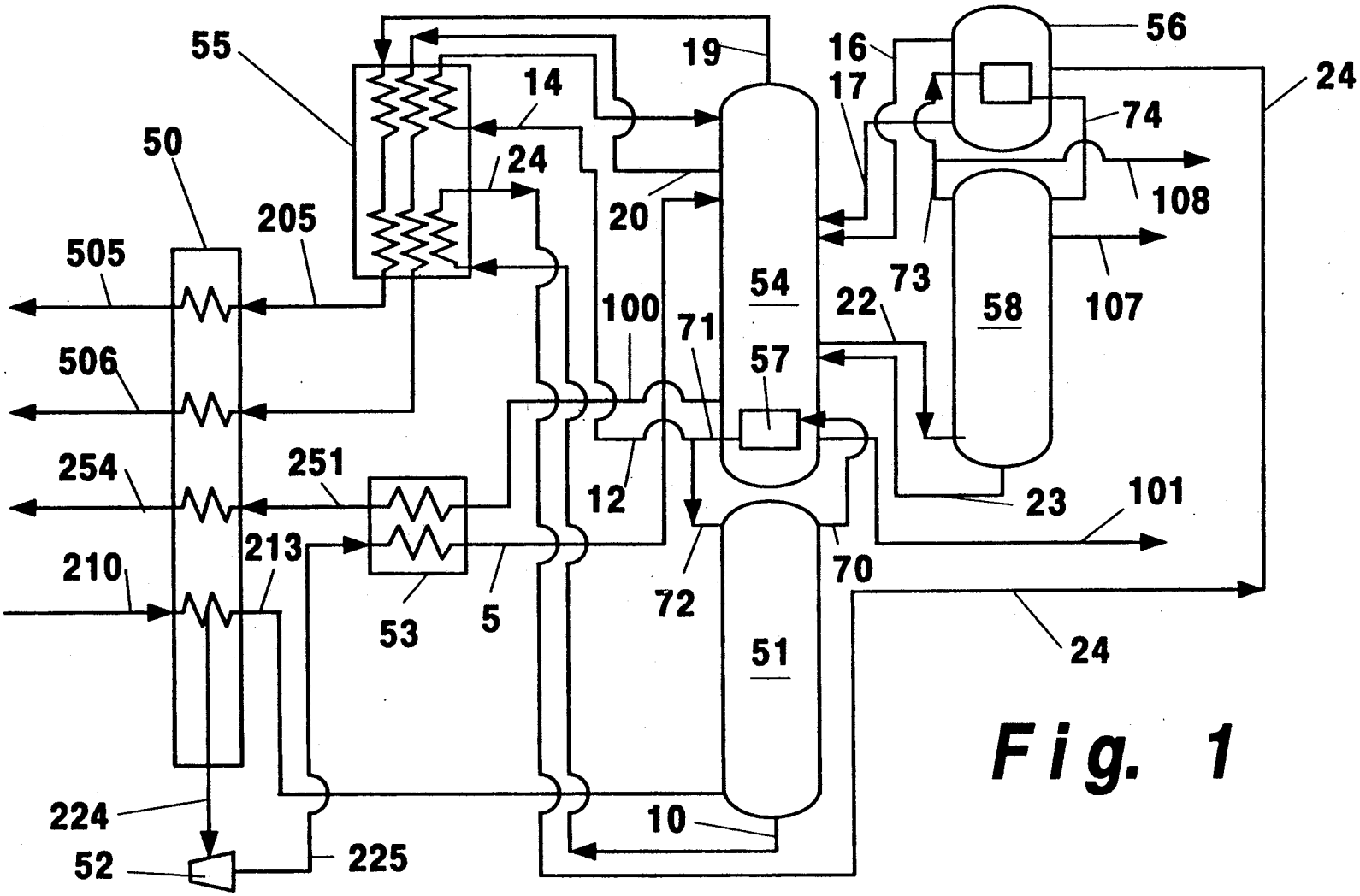
FIG. 1 is a schematic flow diagram of one preferred embodiment of the invention.

Referring now to FIG. 1, cleaned, compressed feed air 210 is cooled by passage through heat exchanger 50 by indirect heat exchange with return streams and resulting cooled stream 213 is passed into column 51 which is the higher pressure column of a double column system and is operating at a pressure generally within the range of from 70 to 95 pounds per square inch absolute (psia). A portion of the feed air 224 is passed through turboexpander 52 for the generation of refrigeration and the resulting turboexpanded stream 225 is passed through heat exchanger 53 wherein it serves to warm an outgoing oxygen product stream. The resulting air stream 5 is then passed into column 54 which is the lower pressure column of the double column system and is operating at a pressure less than that of the higher pressure column and generally within the range of from 15 to 25 psia.

Within column 51 the feed air is separated by cryogenic rectification into oxygen-enriched liquid and nitrogen-enriched vapor. Oxygen-enriched liquid is removed from column 51 as stream 10, passed partially through heat exchanger 55, and the resulting stream 24 passed into argon column top condenser 56 wherein it is partially vaporized by indirect heat exchange with condensing argon column top vapor as will be more fully described later. The resulting gaseous and liquid oxygen-enriched fluid is passed from top condenser 56 as streams 16 and 17 respectively into column 54.

Nitrogen-enriched vapor is removed from column 51 as stream 70 and passed into reboiler 57 wherein it is condensed by indirect heat exchange with boiling column 54 bottoms. The resulting nitrogen-enriched liquid 71 is divided into stream 72 which is returned to column 51 as reflux, and into stream 12 which is passed partially through heat exchanger 55 and then, as stream 14, is passed into column 54.

Within column 54 the various feeds into the column are separated by cryogenic rectification into refined nitrogen and oxygen. Gaseous oxygen is removed from column 54 as stream 100 from above reboiler 57. This stream is then passed through heat exchanger 53 and resulting stream 251 is passed through heat exchanger 50 and then recovered as gaseous oxygen product stream 254. If desired, a liquid oxygen stream 101 may be removed from column 54 from the area of reboiler 57 and recovered as liquid oxygen product. The product oxygen will generally have an oxygen concentration of at least 99.0 percent.

Gaseous nitrogen is removed from column 54 as stream 19 and warmed by passage through heat exchanger 55. The resulting stream 205 is further warmed by passage through heat exchanger 50 and then recovered as gaseous nitrogen product stream 505 generally having an oxygen concentration less than 10 parts per million (ppm). A waste stream 20 is removed from column 54 below the product nitrogen withdrawal point, warmed by passage through heat exchangers 55 and 50 and removed from the system as stream 508. This waste stream serves to maintain Product purity in the nitrogen and oxygen product streams.

In a conventional cryogenic air separation system employing argon recovery, a fluid stream is removed from the lower pressure column at a point at, or a few equilibrium stages below, the point where the argon concentration is at a maximum, and this stream is passed into an argon column for further processing. The balance of the argon column feed stream is primarily oxygen but it also contains about 500 ppm nitrogen. It would be desirable to have a much lower concentration of nitrogen in the argon column feed and this can be done by taking the argon column feed off the lower pressure column at a point significantly lower than is conventionally done. However this procedure is not used because it causes an unavoidable lowering of the argon concentration in the argon column feed resulting in much reduced argon yields because a significant amount of argon is lost out the lower pressure column.

Figure 3:
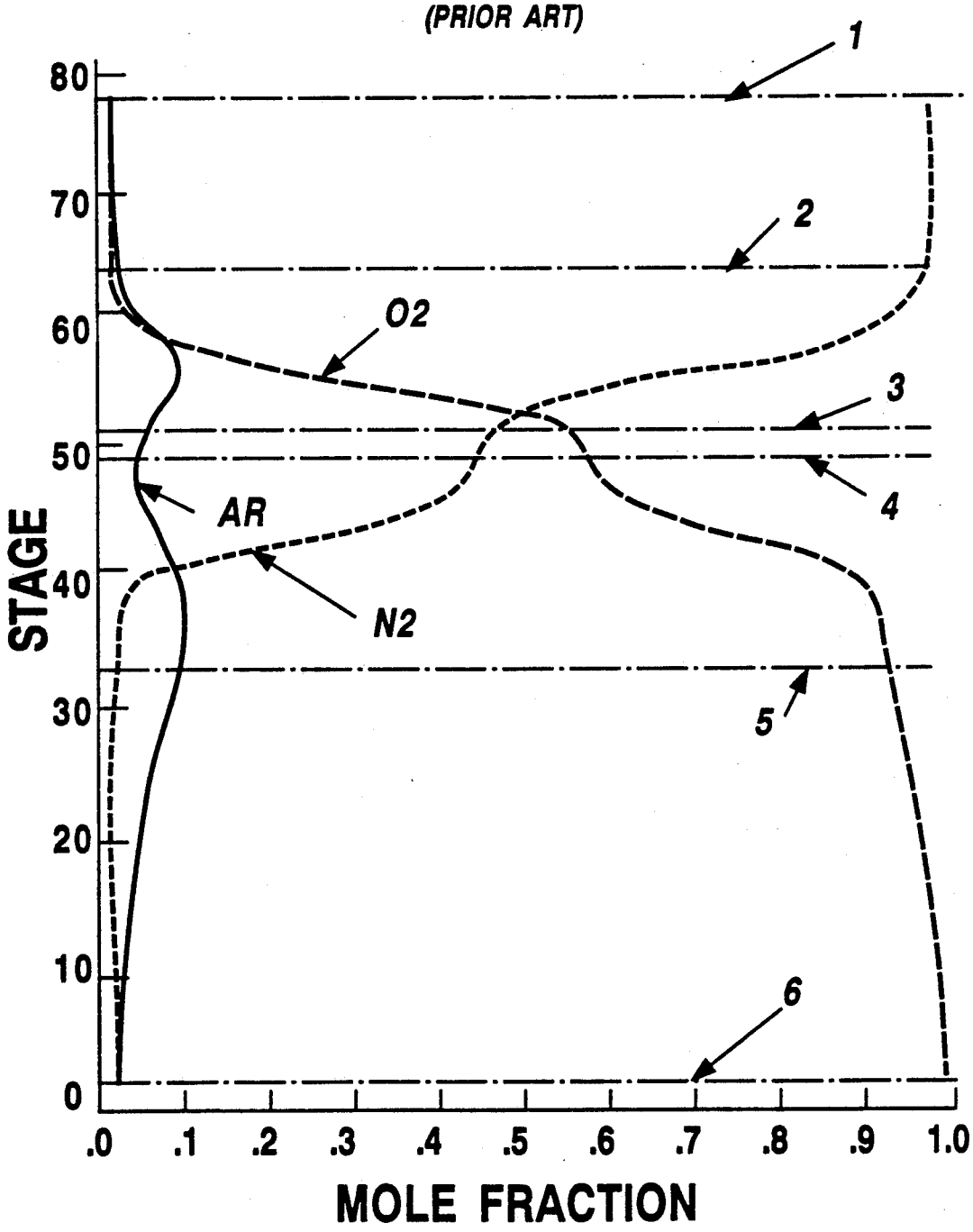
Fig. 3 (PRIOR ART)
FIG. 3 is a graphical representation of the component concentration profile in one typical example of a conventional lower pressure column.
Figure 3A:
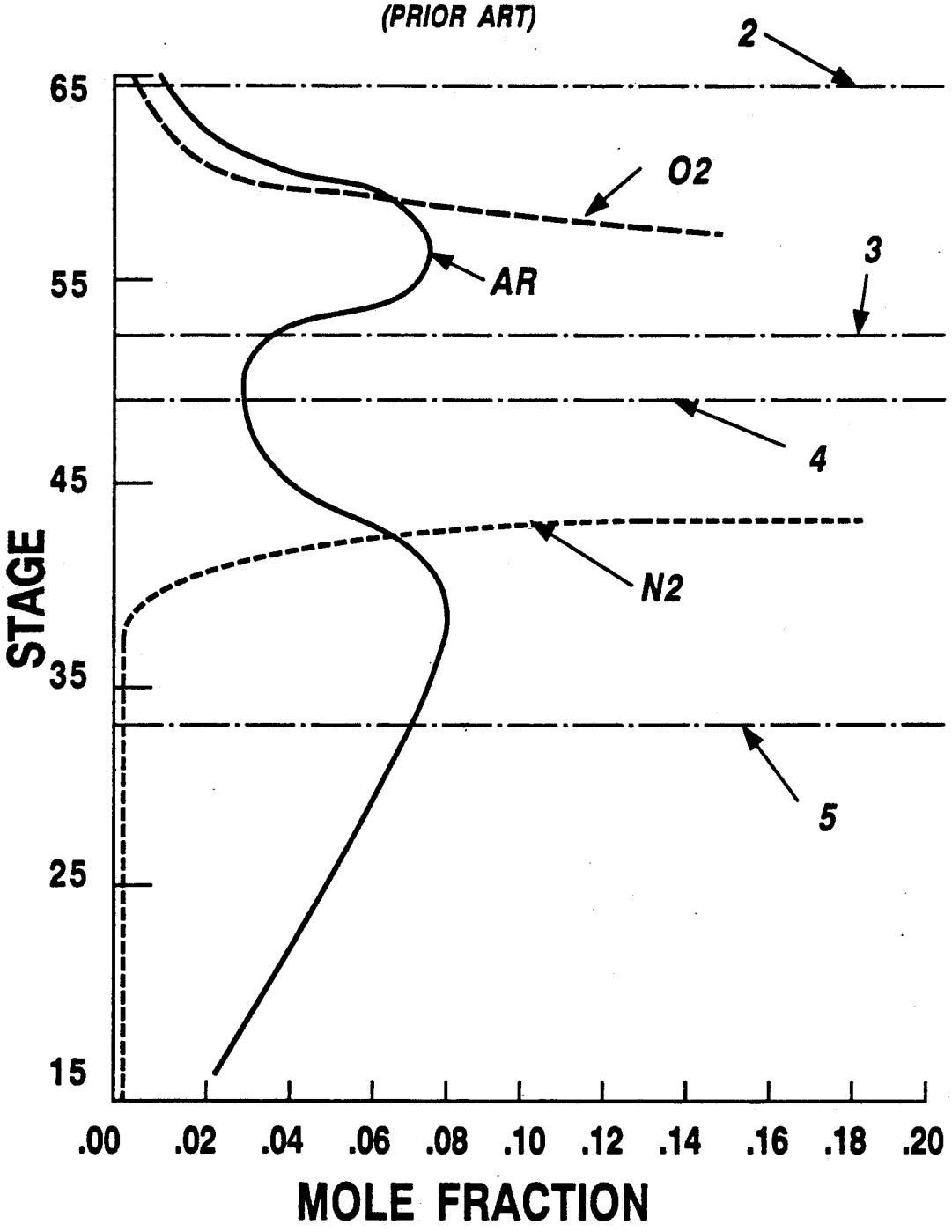
Fig. 3A (PRIOR ART)
FIG. 3A is an enlargement of a portion of FIG. 3.

The prior art situation is illustrated graphically in FIGS. 3 and 3A which show the equilibrium stages of a lower pressure column on the vertical axis and the liquid phase mole fraction or concentration of each of argon, nitrogen and oxygen in the lower pressure column on the horizontal axis. The horizontal demarcation lines illustrate the points where streams are fed into or out of the column. Line 1 is where nitrogen product is withdrawn, line 2 is where the waste stream is removed, line 3 is where liquid from the argon column top condenser is passed into the column, line 4 is where vapor from the argon column top condenser is passed into the column and also where the turboexpanded air stream is passed into the column, line 5 is where the argon column feed is withdrawn and line 6 is where the oxygen product is withdrawn. The argon concentration in the column is shown by the solid line. As can be seen, in conventional practice the argon concentration reaches a maximum in this example of about 8.2 percent at about equilibrium stage 38 and the argon column feed is taken a few stages below this point at equilibrium stage 33 where the argon concentration is about 7.6 percent. The nitrogen concentration in the argon column feed is about 500 ppm. If one took the argon column feed off the lower pressure column at a point significantly below the point of maximum argon concentration, for example at equilibrium stage 20, one could reduce the nitrogen concentration in the argon column feed to less than 50 ppm. However, this reduces the argon concentration to less than 5 percent in the argon column feed. Thus, although argon purity would be enhanced, the reduction in argon recovery or yield would be so high as to make this procedure impractical.

The invention comprises the discovery that if additional equilibrium stages are incorporated into the lower pressure column above the argon column feed withdrawal point which are comprised of packing instead of the conventional trays, there is surprising maintenance of argon concentration over a significant number of equilibrium stages while the nitrogen concentration is being reduced. Thus one can take the argon column feed off the lower pressure column at a point significantly lower than where the argon concentration is at a maximum, thus getting the benefit of the low nitrogen concentration while avoiding the dropoff in argon concentration. The argon column feed is taken from the lower pressure column at a point at least 5 equilbrium stages, preferably at a point at least 10 equilibrium stages, below the point where the argon concentration in the lower pressure column is at a maximum. The nitrogen concentration of the argon column feed is not more than 50 ppm, preferably is less than 10 ppm and most preferably is less than 1 ppm. However, the argon concentration of the argon column feed is still not less than about 7 percent. Thus the feed into the argon column contains very little nitrogen while still containing sufficient argon for effective recovery.

Figure 4:
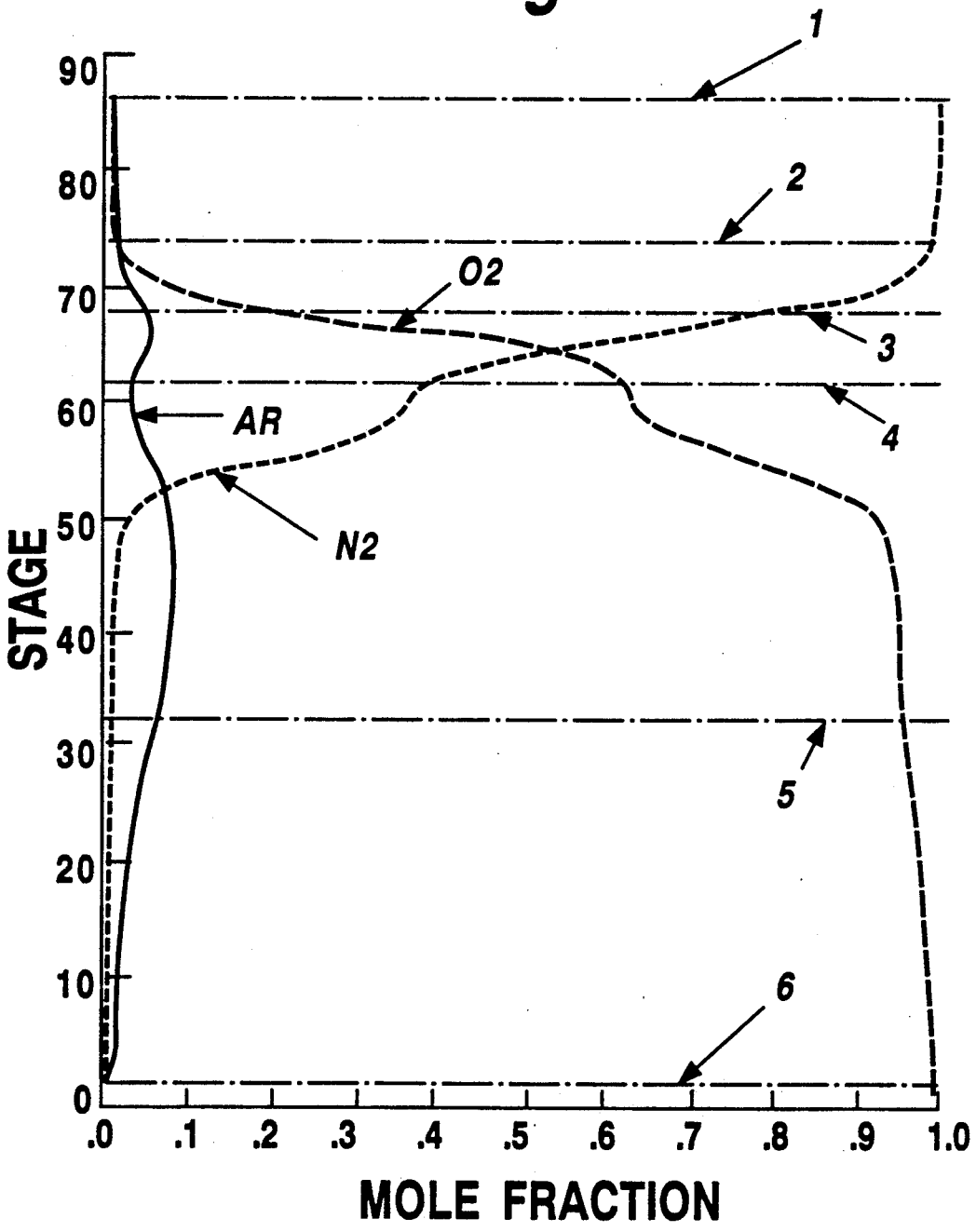
FIG. 4 is a graphical representation of the component concentration profile in one typical example of a lower pressure column employed in the practice of the invention.
Figure 4A:
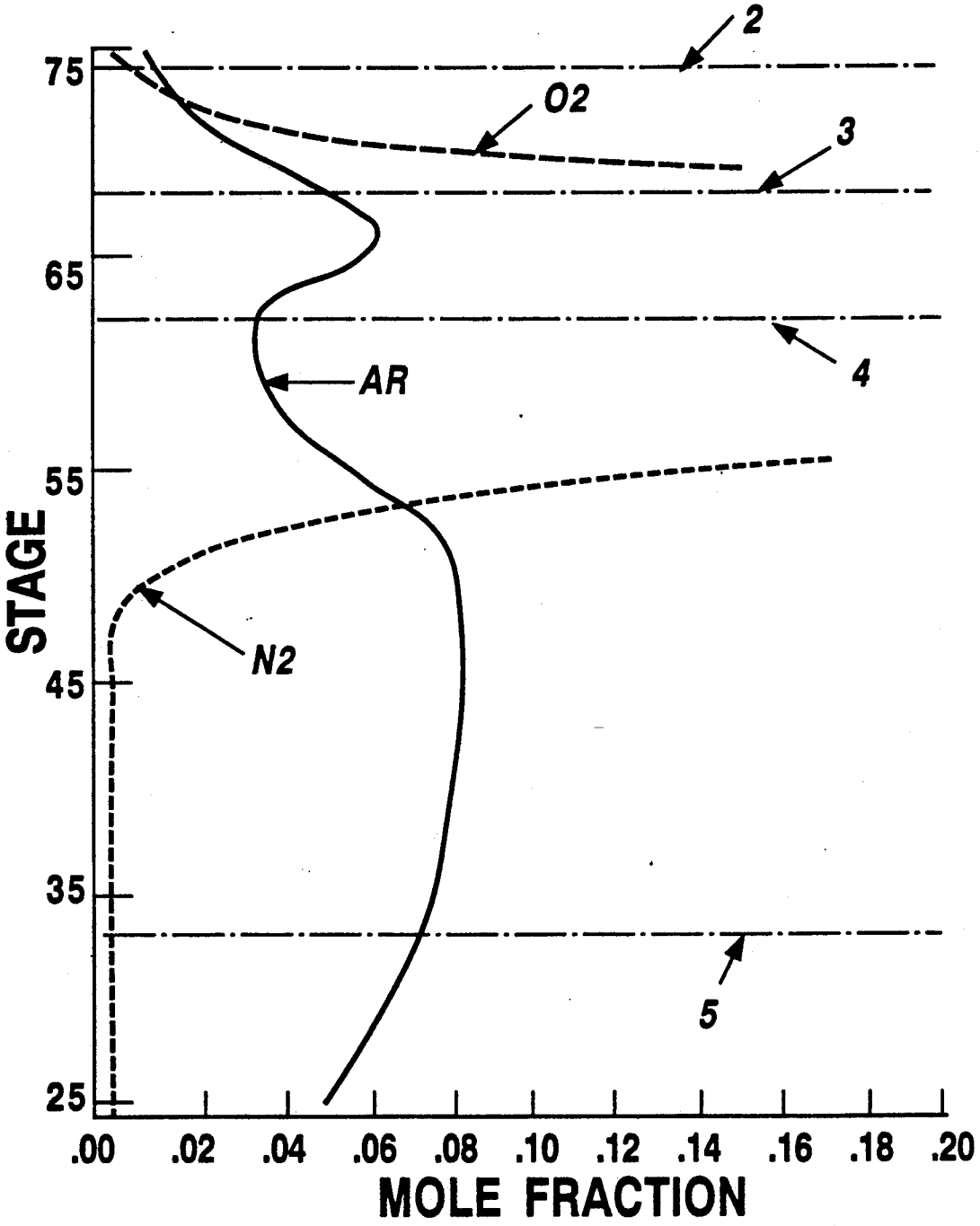
FIG. 4A is an enlargement of a portion of FIG. 4.

The invention is illustrated graphically in FIGS. 4 and 4A which show the equilibrium stages of a lower pressure column in a manner similar to that described with respect to FIG. 3. Dermarcation lines 1, 2, 5 and 6 indicate the same characterization of the streams discussed in FIG. 3. That is, line 1 is nitrogen product, line 2 is waste, line 5 is argon column feed and line 6 is oxygen product. The embodiment of the invention illustrated in FIGS. 4 and 4A is a preferred embodiment wherein line 3 indicates the point where turboexpanded air is introduced into the column and line 4 indicates where vapor and liquid from the argon column top condenser are introduced into the column. Thus, in this preferred embodiment of the invention, turboexpanded air is provided into the column at a stage above where liquid from the argon column top condenser is provided and also the vapor and liquid from the argon column top condenser are both provided into the column at the same equilibrium stage. This is also the arrangement illustrated in FIG. 1.

As can be seen from FIGS. 4 and 4A, in the practice of this invention the argon concentration in the lower pressure column of this example reaches a maximum at about equilibrium stage 45 at a concentration of about 7.7 percent. At this point the nitrogen concentration is about 2000 ppm. However, as one proceeds down the column the argon concentration remains substantially constant or drops off very slowly. This is in contrast to conventional Practice where the argon concentration drops off markedly. However, while the argon concentration is remaining relatively constant the nitrogen concentration is being constantly reduced so that when one gets to the argon column feed withdrawal point at equilibrium stage 33 the nitrogen concentration is less than 50 ppm. At this point the argon concentration is still above 5 percent at about 7.2 percent.

While not wishing to be held to any theory applicants believe that the fortuitous convergence of continued significant nitrogen separation and little or no argon separation may be explained as follows. When trays are used for mass transfer in the low pressure column and the product streams exit the air separation process at near atmospheric pressure, the extent of separation in the low pressure column is limited by the quantity of reflux supplied by the high pressure column regardless of the number of trays used in the upper column. Increasing the number of trays beyond some point produces no additional separation. Typically, this situation causes the nitrogen content of the argon column feed to be approximately 500 ppm nitrogen for maximum recovery of argon. Adjustments to the number of stages, location of feeds and draws, and the flow rate of feeds and draws can reduce the nitrogen content of the argon column feed, but argon recovery is also reduced. When packing is used for mass transfer in the low pressure column, the extent of separation in the low pressure column can be increased from that obtained with trays. This is due in part to an increase in the quantity of reflux supplied by the high pressure column and to improved relative volatilities in the low pressure column resulting from a lower average operating pressure for the column. The number of equilibrium stages in the section of the low pressure column just above the argon column draw can be increased beyond what is feasible and economical with trays providing for further separation of nitrogen from argon and oxygen.

In the practice of this invention either structured or random packing may be employed in the lower pressure column between the point where the argon concentration is at a maximum and the argon column feed withdrawal point. Structured packing is preferred because of its higher separation efficiency.

While the defined equilibrium stages above the argon column feed withdrawal point comprise packing, some or all of the other equilibrium stages in the lower pressure column also may, if desired, comprise packing.

Referring back now to FIG. 1, argon column feed 22 comprising at least 5 percent argon and preferably at least 7 percent argon, not more than 50 ppm nitrogen with the balance substantially oxygen is withdrawn from column 54 and passed into argon column 58 wherein it is separated by cryogenic rectification into oxygen-rich liquid and argon-rich vapor which is nitrogen-free. By nitrogen-free it is meant having not more than 10 ppm nitrogen, preferably not more than 5 ppm nitrogen, most preferably not more than 2 ppm nitrogen. The oxygen-rich liquid is removed from column 58 and returned to column 54 as stream 23. Argon-rich vapor may be recovered directly from the argon column system as nitrogen-free product argon in stream 107. Nitrogen-free product argon may also be recovered as liquid such as from condenser 56.

Some of the argon-rich vapor is passed as stream 73 out from column 58 and into top condenser 56 wherein it is condensed by indirect heat exchange against partially vaporizing oxygen-enriched liquid as was previously described. Resulting liquid stream 74 is returned to column 58 as reflux. A portion of stream 74 may be recovered as liquid nitrogen-free product argon. If desired, a portion 108 of stream 73 may be removed as a waste argon stream. This serves to further reduce the nitrogen concentration in the product argon. If the waste argon stream is employed it is removed from the argon column system at a point at least one equilibrium stage above the point where the argon product is removed from the argon column system.

By use of this invention one can produce and recover directly from the argon column system nitrogen-free argon product thus avoiding the subsequent heretofore necessary nitrogen removal step. If desired, one can employ the invention to produce commercial grade refined argon, i.e. argon having low concentrations of both nitrogen and oxygen, directly from the argon column system. This can be done by incorporating a large number of equilibrium stages, generally at least about 150 equilibrium stages, between the oxygen-rich liquid removal point and the argon product withdrawal point so as to produce an argon product having an oxygen concentration not exceeding 10 ppm. If this procedure is employed the equilibrium stages in the argon column should preferably comprise packing. When this procedure is employed the product refined argon, which can have a nitrogen concentration as low as 2 ppm or less and an oxygen concentration as low as 2 ppm or less, can be recovered directly from the argon column system.

Figure 2:
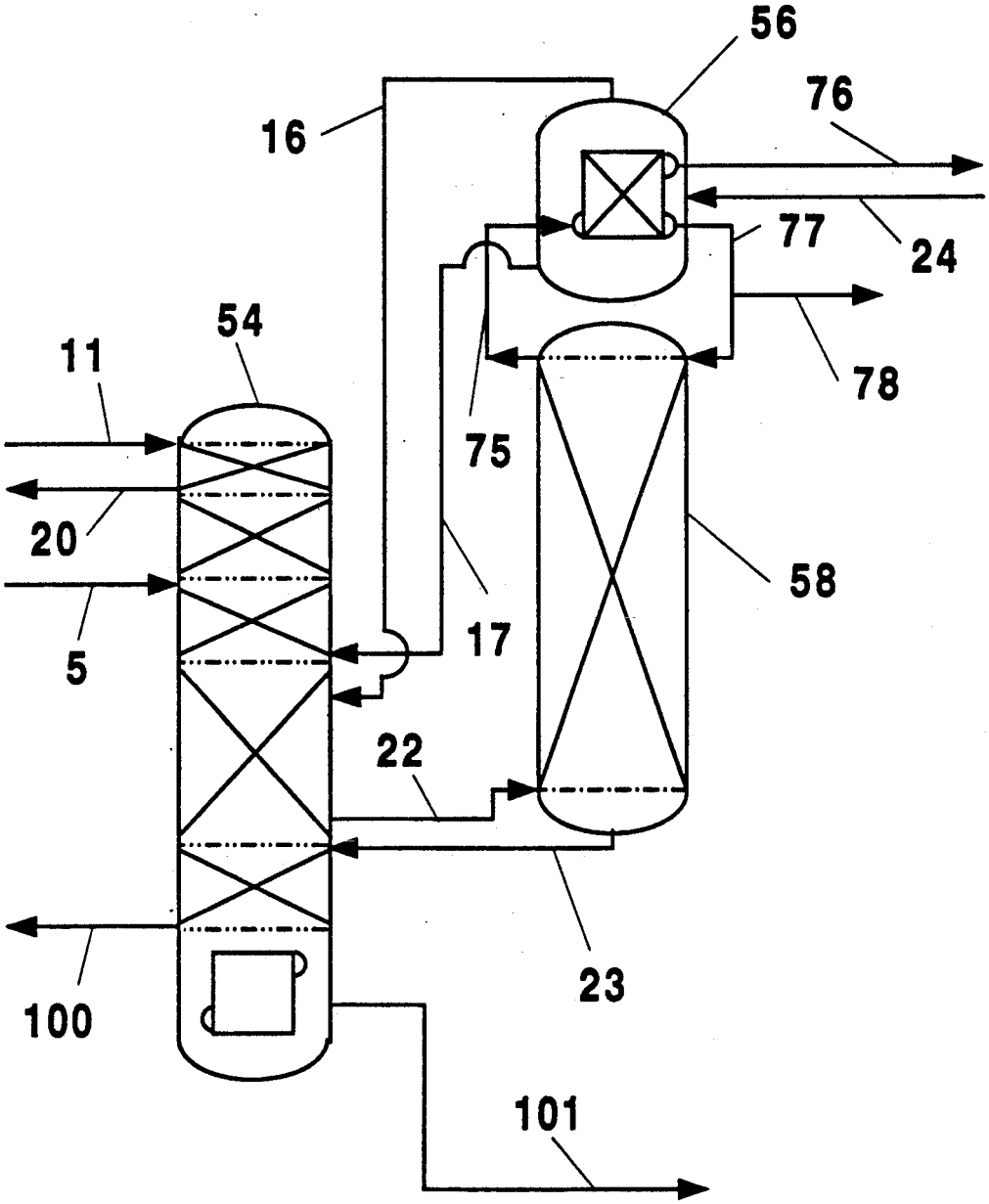
FIG. 2 is a simplified partial schematic flow diagram of another preferred embodiment of the invention.

FIG. 2 illustrates another embodiment of the invention wherein a reflux condenser replaces the section of the argon column above stream 107 in the embodiment illustrated in FIG. 1. FIG. 2 is a partial schematic representation of the process in simplified form and the numerals in FIG. 2 correspond to those of FIG. 1 for the common elements. The functions of these common elements will not be reiterated. In the operation of the embodiment illustrated in FIG. 2, the argon-rich vapor is passed into top condenser 56 wherein it is partially condensed by indirect heat exchange with oxygen-enriched liquid 24. The remaining vapor is passed out of the argon column system as waste stream 76 and the resulting liquid 77 is returned to column 58 as reflux. A portion 78 of argon liquid stream 77 is recovered directly from the argon column system as liquid nitrogen-free argon product. This portion of stream 75 could be recovered a vapor nitrogen-free argon product in addition to or in lieu of stream 78. This embodiment may also be employed with the aforedescribed elongated argon column to produce refined vapor and/or liquid argon product directly from the argon column system.

In the cases where a waste argon stream is employed such as illustrated in FIGS. 1 and 2, the waste argon stream may be recycled back into the overall separation process such as into the double column system so as to avoid the loss of the argon contained in this stream.

Although the invention has been described in detail with reference to certain preferred embodiments, those skilled in the art will recognize that there are other embodiments of the invention within the spirit and the scope of the claims. For example, plant refrigeration may be generated by the turboexpansion of a product or waste stream instead of a feed air fraction or refrigeration may be supplied from an external source by addition of liquid nitrogen or oxygen.

We claim:

1. A method for producing nitrogen-free argon comprising:

(a) separating a feed comprising argon, nitrogen and oxygen by cryogenic distillation in a double column system comprising a higher pressure column and a lower pressure column;

(b) withdrawing a fluid stream from the lower pressure column and passing this stream as argon column feed into an argon column system;

(c) operating the lower pressure column with sufficient equilibrium stages comprising packing above the point where the argon column feed is withdrawn from the lower pressure column so that the withdrawal of the argon column feed from the lower pressure column occurs at least 5 equilibrium stages below where the argon concentration in the lower pressure column is at a maximum and the nitrogen concentration in the argon column feed is less than 50 ppm; and (d) recovering directly from the argon column system argon having a nitrogen concentration not exceeding 10 ppm.

2. The method of claim 1 wherein the withdrawal of the argon column feed from the lower pressure column occurs at least 10 equilibrium stages below where the argon concentration in the lower pressure column is at a maximum.

3. The method of claim 1 wherein the nitrogen concentration in the argon column feed is less than 10 ppm.

4. The method of claim 1 wherein the nitrogen concentration in the argon column feed is less than 1 ppm.

5. The method of claim 1 wherein the argon concentration in the argon column feed is at least 7 percent.

6. The method of claim 1 wherein the packing comprises structured packing.

7. The method of claim 1 wherein the packing comprises random packing.

8. The method of claim 1 wherein the argon recovered directly from the argon column system has a nitrogen concentration not exceeding 5 ppm.

9. The method of claim 1 wherein the argon recovered directly from the argon column system has a nitrogen concentration not exceeding 2 ppm.

10. The method of claim 1 wherein the argon recovered directly from the argon column system comprises vapor.

11. The method of claim 1 wherein the argon recovered directly from the argon column system comprises liquid.

12. The method of claim 1 further comprising removing from the argon column system a waste stream at least one equilibrium stage above where the argon is recovered directly from the argon column system.

13. The method of claim 12 wherein the waste stream is recycled back into the double column system.

14. The method of claim 1 further comprising operating the argon column of the argon column system with at least 150 equilibrium stages.

15. The method of claim 14 wherein the equilibrium stages in the argon column comprise packing.

16. The method of claim 14 wherein the argon recovered directly from the argon column system is refined argon having an oxygen concentration not exceeding 10 ppm.

* * * * *

UNITED STATES PATENT AND TRADEMARK OFFICE

CERTIFICATE OF CORRECTION

PATENT NO. : 5,133,790

DATED : July 28, 1992

INVENTOR(S) : J. R. Bianchi, et al.

It is certified that error appears in the above-identified patent and that said Letters Patent is hereby corrected as shown below:

In column 2, line 58 between "pressures" and "will" insert --for the components. The high vapor pressure (or more volatile or low boiling) component will tend to concentrate in the vapor phase whereas the low vapor pressure (or less volatile or high boiling) component--.

Signed and Sealed this

Tenth Day of August, 1993

*Attest:*

Michael K. Kirk

MICHAEL K. KIRK

*Attesting Officer*

*Acting Commissioner of Patents and Trademarks*